US005881807A

United States Patent [19]

Bøe et al.

[11] Patent Number: 5,881,807

[45] Date of Patent: Mar. 16, 1999

[54] INJECTOR FOR INJECTING A TRACER INTO AN OIL OR GAS RESERVIOR

[75] Inventors: Einar Bøe; Hans Paul Carlsen, both of Notodden; Stig Holgersen, Hinna; Olav Sveinung Haugerud, Bø i Telemark, all of Norway

[73] Assignee: Altinex AS, Kokstad, Norway

[21] Appl. No.: 750,178

[22] PCT Filed: May 30, 1995

[86] PCT No.: PCT/NO95/00084

§ 371 Date: Mar. 6, 1997

§ 102(e) Date: Mar. 6, 1997

[87] PCT Pub. No.: WO95/33121

PCT Pub. Date: Dec. 7, 1995

[30] Foreign Application Priority Data

May 30, 1994 [NO] Norway ..... 941992

[51] Int. Cl.[6] ..... E21B 49/10

[52] U.S. Cl. ..... 166/100; 166/169; 73/152.29

[58] Field of Search ..... 166/169, 66.4, 166/252.6, 250.01, 250.12, 100; 73/152.29, 152.42, 152.36

[56] References Cited

U.S. PATENT DOCUMENTS

| | | | |
|---|---|---|---|
| 2,381,929 | 8/1945 | Schlumberger | 166/169 |
| 2,915,123 | 12/1959 | Lebourg | 166/169 |
| 3,253,654 | 5/1966 | Briggs, Jr. et al. | 166/169 |
| 3,318,381 | 5/1967 | Brandt | 166/305.1 |
| 4,558,219 | 12/1985 | LeBlanc et al. | 250/260 |
| 4,771,635 | 9/1988 | Trevillion | 73/155 |
| 5,168,927 | 12/1992 | Stegemeier et al. | 166/252.6 |

*Primary Examiner*—Frank S. Tsay

*Attorney, Agent, or Firm*—Wenderoth, Lind & Ponack, L.L.P.

[57] ABSTRACT

An injector (1) for injecting a traceable material into an oil and/or gas reservoir is lowered down into a bore hole that is in communication with the reservoir. An electro-hydraulic system is activated to inject a traceable material stored in a container into the reservoir. The injector is provided with a gland plate (7) that seals a space between the injector and the wall of the bore hole (16) in a manner that prevents traceable material from being distributed in the bore hole, but secures direct injection of the material into the reservoir. The injector is adapted to be positioned at a specific depth level in the bore hole, and to be cleaned by pressurized liquid after the injection operation is completed.

19 Claims, 6 Drawing Sheets

INJECTOR FOR INJECTING A TRACER INTO AN OIL OR GAS RESERVIOR

BACKGROUND OF THE INVENTION

This invention relates to an injector for injecting a traceable material or a tracer into a bore hole that is connected to an oil and/or gas reservoir.

When a promising reservoir of oil and/or gas is discovered, the following procedure is used to determine the size and shape of the reservoir. The field is divided into a number of geometrical squares, followed by the performing of a drilling operation to obtain bore holes in the squares. In some of the bore holes there are placed injectors according to a certain pattern, and at various depths. A traceable material is then injected from the injectors into the oil and/or gas reservoir, followed by measuring the amount of distribution of tracer or tracer elements. This measurement is performed by providing an amount of detectors placed in near and distantly located bore holes according to a pre-calculated geometrical pattern. The tracer injections may be repeated after a certain time, at intervals, in dependence on the content of the reservoir, the permeability, the temperature and pressure, and finally the properties of the traceable material.

Two different arrangements for injecting a traceable material in an oil and/or gas reservoir have been known for a long time. One arrangement comprises the provision of an explosive charge in relation to a piston in the injector. The charge may for instance be detonated by means of a timer, whereby the piston compresses a container of traceable material, followed by the injection of the contents into the reservoir.

The other arrangement, e.g. as described in U.S. Pat. No. 4,220,264, comprises a hydraulic system with a piston, manually actuated by the provision of a valve/spring device that compresses a container of traceable material, followed by the injection of the traceable material into the reservoir.

The above mentioned arrangements are encumbered with considerable disadvantages. One disadvantage that occurs when using a timer, or when the depth level is indicated by measuring the wire length that is paid out, is that the calculated depth level may be encumbered with considerable calculation errors since the lowering speed may vary, caused by speed variations in the winch motor, strain in the wire, and finally the lowering operation itself may be disturbed by faults. Further, it is difficult to estimate the most favorable charge for a satisfactory distribution of the traceable material.

Another disadvantage in injection of the traceable material into the reservoir is that the annulus defined between the injector and the wall in the bore hole will not be sealed. As a result of this, the precise depth level of injection may not be exactly determined, because the traceable material is allowed to distribute lengthways in the bore hole before entering the reservoir. Consequently, the calculations of such reservoir parameters as the amount of oil and gas, the depths and the dissemination will be encumbered with statistical uncertainty.

A further disadvantage is that over a period of time, tracer material will accumulate in and upon the injector. When applying a radioactive material, for instance cesium, repeated handling of the injector may cause health injuries to the operators.

It is therefore important that the injector has provisions to be cleaned after the injection, and that the depth level of the bore hole may be exactly determined to measure the distribution of the tracer, and accordingly the character of the reservoir can be calculated very precisely.

SUMMARY OF THE INVENTION

By the present invention has been developed an injector for injecting a traceable material in an oil and/or gas reservoir that is substantially improved in comparison with known injector arrangements.

The injector according to the invention is reliable in operation, easy to operate and precise in use. Further, the injector has favorable production and operation costs, and is safe as to the health of the operators.

According to the present invention, the above mentioned advantages are achieved by an injector as described in the introduction. The injector is characterized in that the traceable material is injected into the reservoir through a gland plate or the like. The plate is arranged to be stored in a retracted position in the injector when lowering or pulling up the injector, and is arranged to be pressed into abutment with the wall in the bore hole when performing the injection operation.

BRIEF DESCRIPTION OF THE DRAWINGS

One way of carrying out the invention is described below with reference to drawings that illustrate one specific embodiment, and in which:

FIGS. 3*a*–3*f* are together longitudinal section of the injector in

FIG. 2, on an enlarged scale, but divided into numbered sections;

DETAILED DESCRIPTION OF THE PREFERRED EMBODIMENTS

Figure 1:
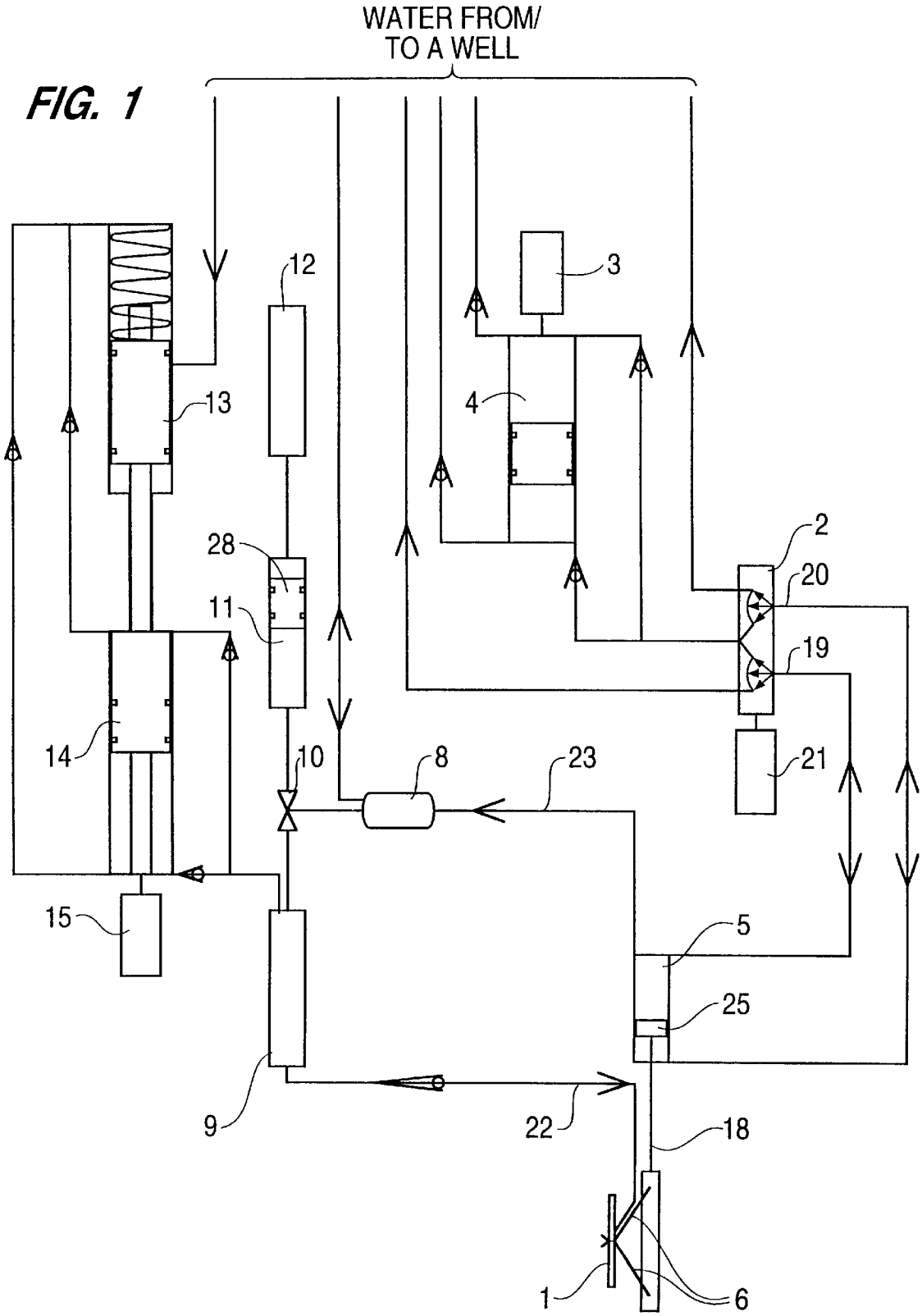
FIG. 1 shows a flowsheet of main components included in the invention.

FIG. 1 shows a principle by which the injector is constituted.

Figure 2:
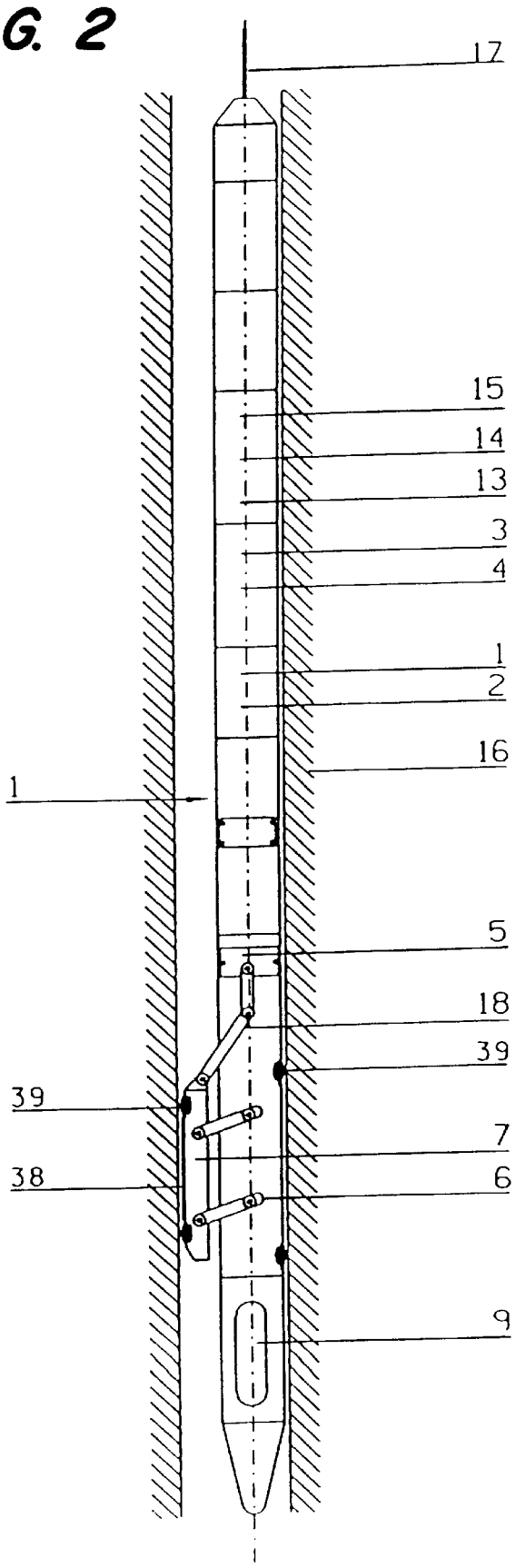
FIG. 2 schematically illustrates an injector according to the invention.
Figure 3A:
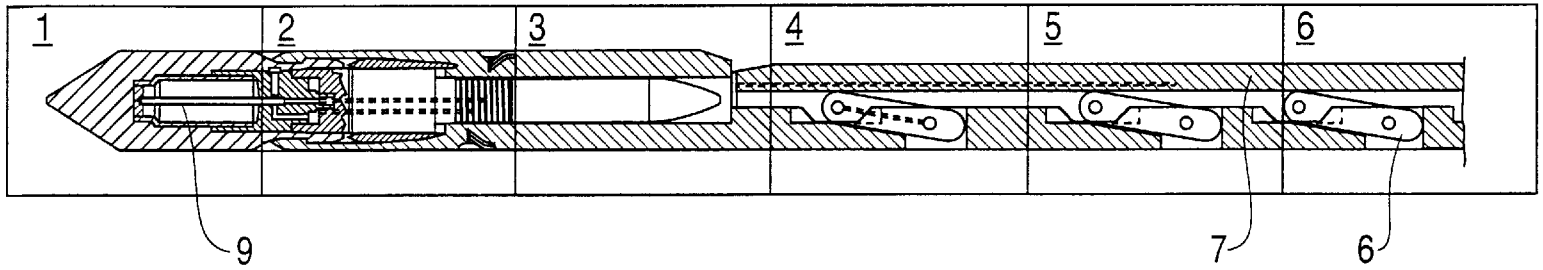
Figure 3B:
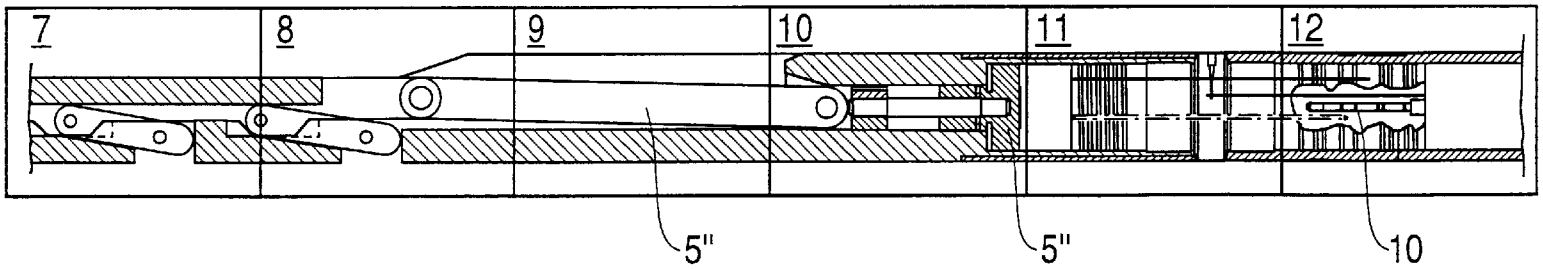
Figure 3C:
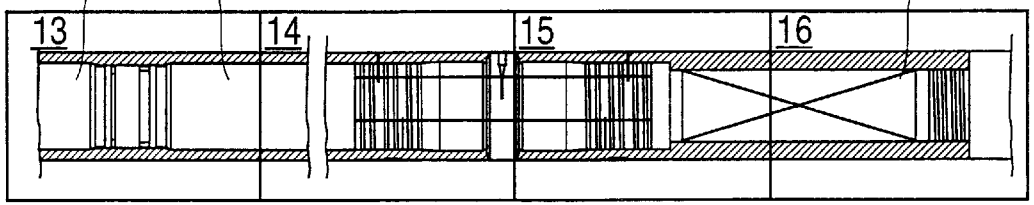
Figure 3D:
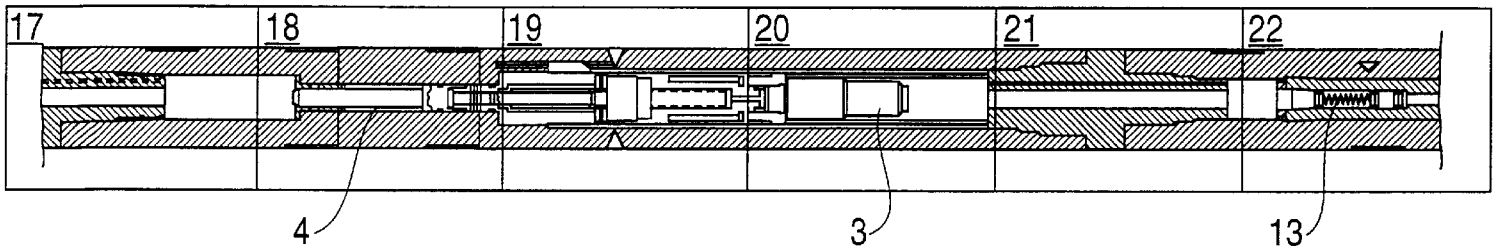
Figure 3E:
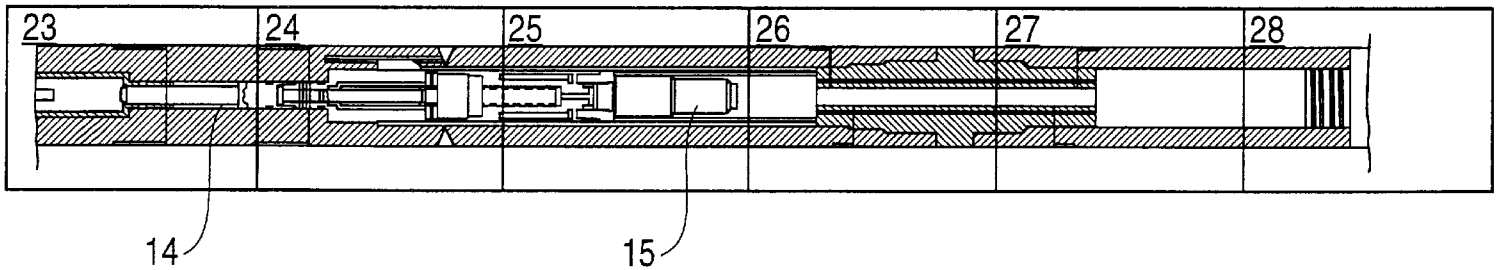
Figure 3F:
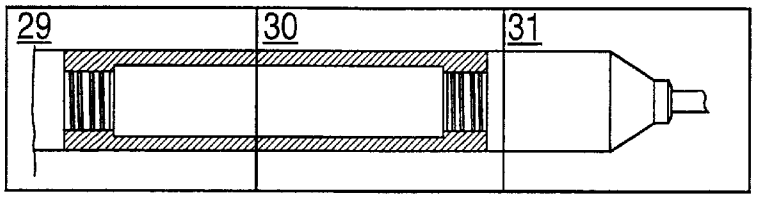

The injector is shaped as a relatively long and cylindrical, or approximately cylindrical, object, and will also be seen in FIGS. 2, 3 and 4.

A computer that controls a control panel (not shown) may be placed on the earth surface or on board a surface vessel. The computer comprises, among other things, a data recording module and a calculation/control module. These modules are connected with electrotechnical components in the injector by a combined element consisting of a hoisting wire and a current carrying cable 17.

The recording module in the control panel receives a number of data concerning pressure, depth and temperature at different depth levels in the bore hole via sensors (not shown) arranged in the injector. Calculations are performed in the calculation module, and then control signals at a certain sequence will be transmitted to the electrotechnical components in the injector via the current carrying cable.

The data will be stored in situ, but in addition data will be stored in a database with a high memory capacity. This database may have a distant location, possibly on shore.

An injector 1 is preferably provided with three hydraulic or fluid systems, as shown in FIG. 1, where:

1. A first system comprises a gland plate 7, arranged to be brought into abutment with the wall of the bore hole by the means of lever arms/pantograph 6. The lever arms/pantograph is operated by a piston rod 18 forming a part of a piston/cylinder device 5, 25. The latter is connected by means of lines or bores 19 and 20 to a slide valve 2 controlled by an electric motor 21. Further, the system comprises a piston pump 4 driven by an electric motor 3 in such a manner that pressurized well fluid is transported to the cylinder 5 via the slide valve 2 and the connections 19 and 20. The fluid transported to the cylinder 5 will be led to the one side of the piston 25 or the other, depending on the position of the slide valve 2. When the piston 25 is in the position as shown in FIG. 3, section 10, the pantograph 6 and the gland plate 7 are in a retracted position in the injector.
2. A second system comprises a piston pump 14 and a slide valve 13 operated by an electric motor 15 in such a manner that traceable material contained in a chamber 9 is injected under pressure into the reservoir via a connection 22, the pantograph 6 and the gland plate 7.
3. A third system consists of a liquid chamber 11, a piston 28 and a gas chamber 12 actuated by means of a valve 10. The piston 28 is forcing liquid, preferably brine, under high pressure out of the chamber 11 to clean the chamber 9, the connection 22, pantograph 6 and the gland plate 7.

When the injector is lowered down to a specific depth level in the bore hole, the electric motor 21 places the slide valve 2 in a position allowing well fluid to flow to the cylinder 5 via the connection 20. The electric motor 3 is then put into operation to drive the piston pump 4 which supplies well fluid to the cylinder 5 via connection 20. The well fluid is thereby pressurized to move the pantograph and the gland plate outwardly relative to the injector by means of piston rod 18 connected to piston 25. The elements are moved outwardly until the gland plate is brought into abutment with the wall of the well (see FIG. 2), to obtain a sealed communication between the injector and the reservoir.

The electric motor 15 is adapted to reposition the slide valve 13 to allow fluid to flow to the piston pump 14. The piston pump 14 delivers high pressurized well fluid to a trace material container located in chamber 9, whereby the contents are forced out of the container, through connection 22, the pantograph 6, gland plate 7 and finally into the reservoir.

After the traceable material has been injected into the reservoir, the slide valve 2 is repositioned by the electric motor 21 to allow the piston pump to force well fluid through the connection 19 to replace the piston 25, the pantograph 6 and the gland plate 7 back to the initial position as shown in FIGS. 3, sections 4 to 10. As the well fluid is forced back through connection 19, the pressure in cylinder 5 rises immediately and is distributed through the connection 23, reaching a ramification device 8 that is connected to a valve 10. Valve 10 is adapted to be opened and to release propellant gas in gas chamber 12 to let the liquid in chamber 11 be forced out through trace chamber 9, connection 22, pantograph 6 and gland plate 7, thereby cleaning the elements.

FIG. 2 shows schematically the injector lowered down into a bore hole, the pantograph 6 being in an extracted position, with the gland plate 7 brought into abutment with the wall of the bore hole, and the injector being ready for injecting a tracer into the reservoir. In FIG. 3, a longitudinal section of the injector is shown, where the injector is divided into sections 1 to 31 for the sake of clarity. At the one end of the injector, i.e. in sections 26 to 31, there are located electrotechnical components such as actuators and sensors (not shown) forming a part of the operation and control systems. These components will not be further described since they do not represent a part of the invention as it is defined in the claims.

Sections 16 to 20 comprise electric motors 21 and 3 adapted to control the slide valve 2 and to drive the piston pump 4, respectively, to provide for the transport of well fluid to cylinder 5 via connections 19 and 20. This arrangement is similar to the hydraulic circuit described previously.

Sections 22 to 25 comprise the electric motor 15 that controls the slide valve 13 and drives the piston pump 14 for the transport of tracer into the reservoir, similar to the hydraulic circuit as described above.

Sections 12 and 13 show the valve 10 adapted to be opened at a certain pressure to initiate the release of gas contained in chamber 12, and thereby forcing out fluid contained in chamber 11 to perform a cleaning operation of tracer chamber 9, connection 22, pantograph 6 and gland plate 7. This arrangement is similar to the hydraulic system 3 as previously described. The tracer chamber 9, with the tracer container (shown schematically), is shown in FIG. 3, sections 1 to 3.

Figure 4A:
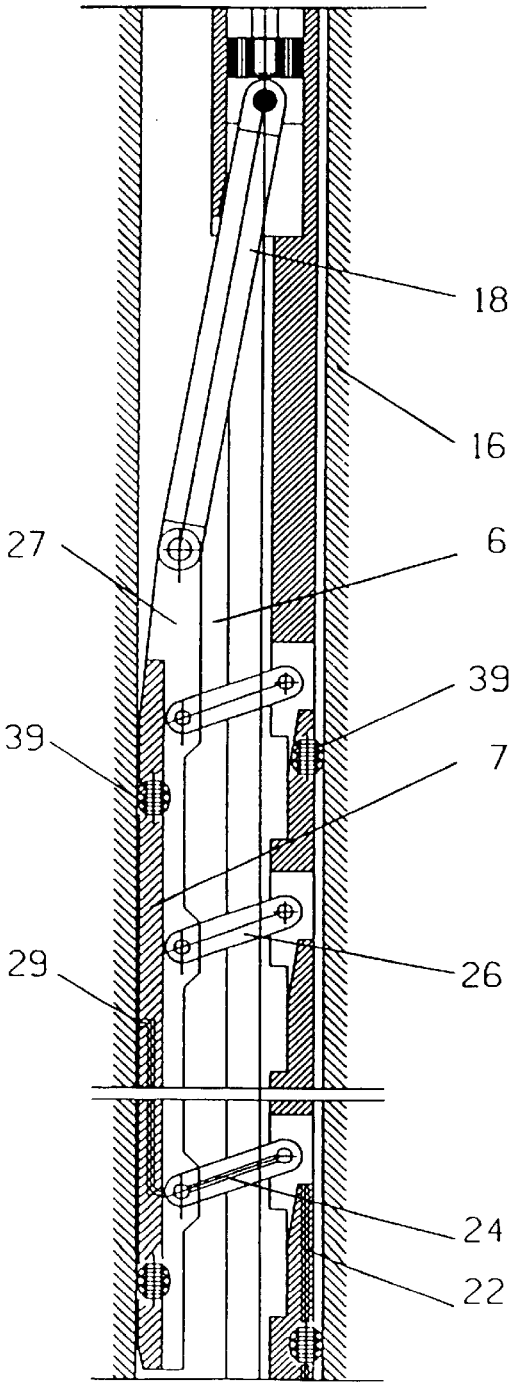
FIG. 4*a*, 4*b*, and 4*c* show, on a further enlarged scale, a pantograph mechanism that is a part of the invention and shown in FIG. 2 and FIG. 3*a*–3*f;*

FIG. 4*a* shows, on a further enlarged scale, the lever arms/pantograph 6 with the gland plate 7 in an extracted position, i.e. the gland plate 7 being forced into abutment with the well wall 16. Lever arms 26 are hinged to a supporting structure 27 of the gland plate 7 by a pivotal connection and to a mounting portion 27*a* of the body of the injector. Further, the supporting structure 27 is connected to the piston 25 in cylinder 5 by means of piston rod 18 and pivotal connections. The tracer is transported from the tracer chamber 9 via the connection 22 in the injector wall, and further via a tube or hose 24 and through a bore 29 in the gland plate 7. As shown in FIGS. 4*b* and *c*, the gland plate 7 is adapted to fit the wall in the bore hole (well casing), and is provided with a packing 30 to obtain a tight connection when in abutment with the wall.

Figure 4C:
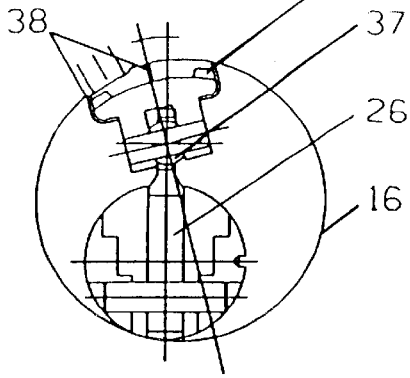
Figure 4B:
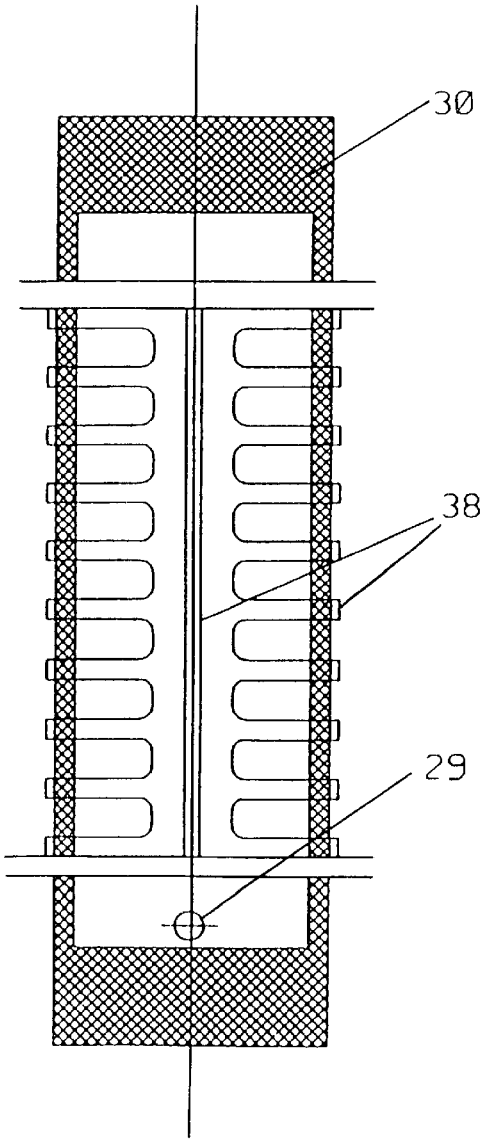

As will be seen in FIG. 4*c*, the gland plate 7 is connected to the lever arms 26 by a two-way pivot bearing 37. The purpose of this bearing arrangement is to provide a correct alignment of the gland plate 7 to obtain a tight abutment with the well wall 16. It will further be seen in FIGS. 4*b* and *c* that the gland plate 7 is equipped with one or more lugs or projections 38 adapted to come into engagement with holes/perforations or beads formed in the well wall 16. The injector may be provided with cantilevered rolls 39 or wheels arranged at the gland plate and at the injector body, respectively, rendering it possible to rotate the injector, for instance when searching for openings in the well wall.

Figure 5:
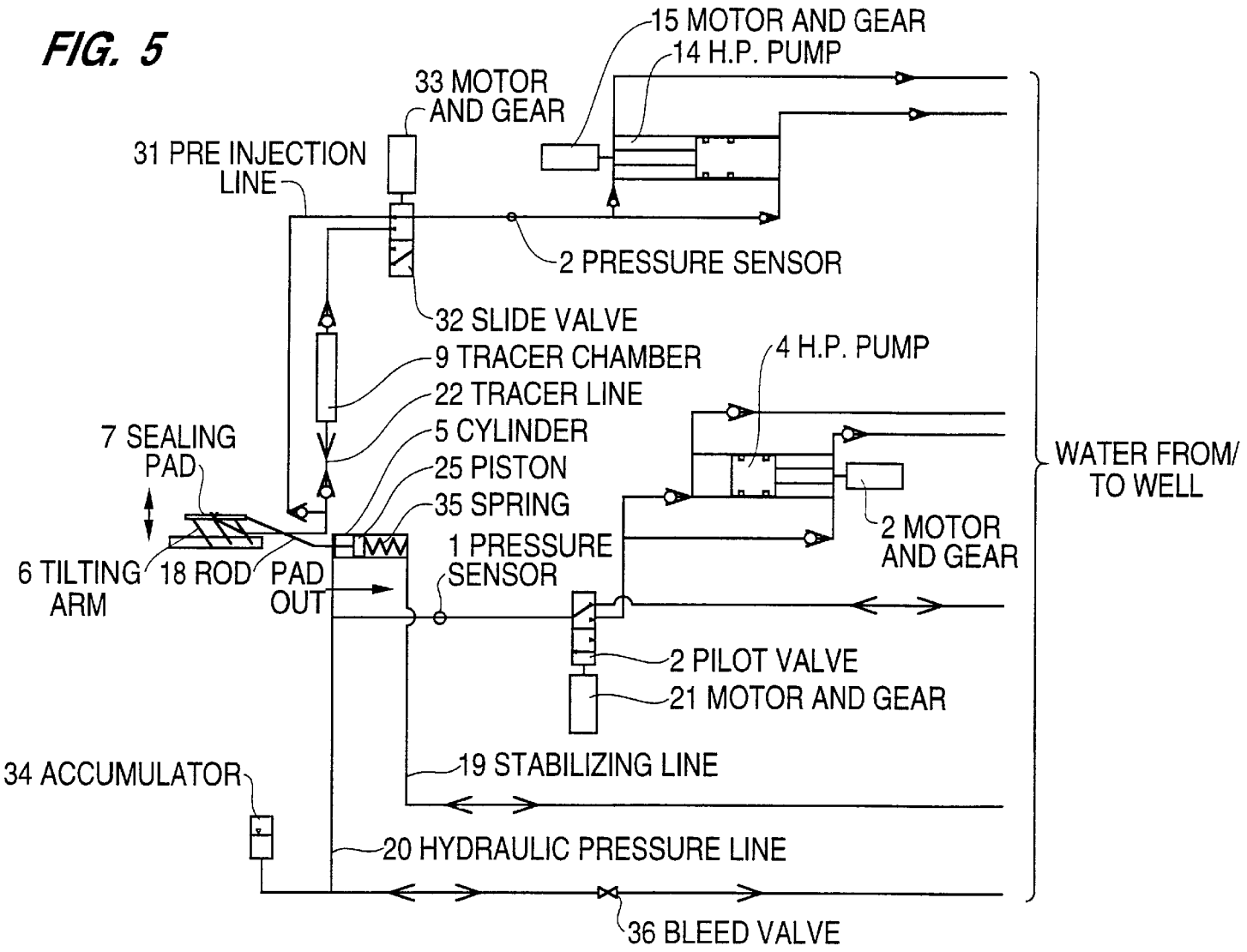
FIG. 5 is an alternative embodiment of a hydraulic system as shown in FIG. 1.

FIG. 5 shows an alternative embodiment of the hydraulic systems as shown in FIG. 1 and as described previously.

As a replacement for the hydraulic system with a separate chamber 11 containing brine for pressure cleaning of the tracer chamber 9, both the injection and cleaning operations may be performed by the hydraulic system 2, where the system in addition comprises means for pre-injection of well fluid before injecting the tracer. The pre-injection is, as mentioned previously, desirable to determine whether the gland plate 7 is in contact with the reservoir or not. The pre-injection system comprises a pre-injection line (bores/pipes) 31, a slide valve 32 actuated by a motor 33 and finally a pump 14. The system is activated when the valve 32 is moved to obtain a connection between the pump 14 and the line 31 that is in communication with the gland plate 7. After the pre-injection operation is achieved, i. e. after communication with the reservoir is achieved, the slide valve is rearranged to be prepared for injection of the tracer as described in the explanations of FIG. 1.

FIG. 5 shows in addition a safety device for releasing the gland plate 7 when a failure in the hydraulic system 1 or control system for the injector possibly occurs in communication with the bore/pipe connection (hydraulic pressure line) 20 there is arranged a pressure accumulator 34, a return spring 35 and finally drainage holes 36. Should any failure as mentioned above occur, drainage hole 36 will provide a bleeding of the hydraulic system 1 and a pressure drop in the same, allowing the spring to retract the gland plate 7 to a retracted position in the injector. The lever arms 6 that are hinged to the injector, at an inclined angle to the length axis of the same, effect a withdrawal of the gland plate relative to the well wall when pulling the injector cable 17.

We claim:

1. An injector for injecting a traceable material into a bore hole in communication with an oil or gas reservoir, comprising:

a container for traceable material;

an injecting mechanism connected with said container; and a gland plate movably mounted to a mounting portion by a lever mechanism, said container for traceable material being fluidly connected with said gland plate, wherein said gland plate is movable by said lever mechanism relative to said mounting portion between a retracted position and a projected position, in which projected position said gland plate can engage with a bore hole for injection of the traceable material of said container by said injecting mechanism.

2. The injector of claim 1, wherein said lever arm mechanism comprises parallel lever arms pivotally mounted between said gland plate and said mounting portion.

3. The injector of claim 1, wherein said gland plate is connected to said lever mechanism by a two-way pivot bearing.

4. The injector of claim 1, wherein said gland plate comprises at least one projection thereon for engagement with holes or beads of a wall of the bore hole.

5. The injector of claim 1, wherein said gland plate and said mounting portion comprise rollers projecting outwardly thereof.

6. The injector of claim 1, wherein said lever arm mechanism comprises lever arms pivotally connecting said gland plate with said mounting portion and a piston and cylinder device comprising a piston, a cylinder, and a piston rod interconnected with said gland plate and said lever arms so as to move said gland plate between said retracted and said projected positions upon movement of said piston in said cylinder.

7. The injector of claim 1, and further comprising a hydraulic system connected with said piston and cylinder device, said hydraulic system comprising a pump driven by a first electric motor and a slide valve controlled by a second electric motor, said pump being connected to said piston and cylinder device through said slide valve.

8. The injector of claim 1, wherein said injecting mechanism comprises a pump operated by an electric motor connected to said container for traceable material for forcing well fluid through said container to said gland plate.

9. The injector of claim 1, and further comprising a cleaning system fluidly connected to said container for traceable material and said gland plate, said cleaning system comprising a pump connected to a fluid source, said pump being operated by an electric motor.

10. The injector of claim 1, and further comprising a cleaning system fluidly connected to said container for traceable material and said gland plate, said cleaning system comprising a pressurized fluid contained in a second container that is fluidly connectable with said container for traceable material.

11. The injector of claim 10, wherein said cleaning system further comprises a third container containing pressurized gas, said third container being connected with said second container.

12. An injector for injecting a traceable material into a bore hole in communication with an oil or gas reservoir, comprising:

an injector body comprising a mounting portion;

a container for traceable material in said injector body;

an injecting mechanism connected with said container; and a plate having a hole therein movably mounted to said mounting portion by a lever arm mechanism, said container for traceable material being fluidly connected with said hole in said plate, wherein said plate is movable by said lever arm mechanism relative to said mounting portion between a retracted position and a projected position, in which projected position said plate can engage with the bore hole for injection of the traceable material of said container by said injecting mechanism.

13. The injector of claim 12, wherein said lever arm mechanism comprises lever arms pivotally connecting said plate and said mounting portion of said injector body and an actuator for moving said plate relative to said mounting portion between said retracted and projected positions by relative pivoting of said lever arms with respect to said plate and said mounting portion.

14. The injector of claim 12, wherein said plate is connected to said lever mechanism by a two-way pivot bearing.

15. The injector of claim 12, wherein said plate comprises at least one projection thereon for engagement with holes or beads of a wall of the bore hole.

16. The injector of claim 12, wherein said plate and said mounting portion comprise rollers projecting outwardly thereof.

17. The injector of claim 12, wherein said injecting mechanism comprises a first hydraulic system including a pump connected to said container for pumping fluid to said container, and said actuator comprises a second hydraulic system comprising a pump for hydraulically moving said actuator.

18. The injector of claim 12, and further comprising a cleaning system comprising a third hydraulic system connected to said container, said third hydraulic system including a pressurized fluid source for cleaning of said container and said plate.

19. An injector for injecting a traceable material into a bore hole in communication with an oil or gas reservoir, comprising:

an injector body comprising a mounting portion;

a container of traceable material in said injector body;

a plate having a hole therein, said container for traceable material being fluidly connected with said hole in said plate;

lever arms connecting said plate and said mounting portion;

means for moving said plate relative to said mounting portion on said lever arms between a retracted position and a projected position, in which projected position said plate can engage with the bore hole for injection of the traceable material of said container; and means for injecting the traceable material in said container from said plate into the bore hole.

* * * * *